428-919 SR
PFR18 XR 4,082,586

United States Patent [19] [11] 4,082,586
Osment [45] Apr. 4, 1978

[54] METHOD OF MAKING MODEL TREES AND ARTICLE

[76] Inventor: David L. Osment, 9904 W. 70th Ter., Shawnee Mission, Kans. 66203

[21] Appl. No.: 611,903

[22] Filed: Sep. 10, 1975

[51] Int. Cl.[2] ..... A41G 1/00
[52] U.S. Cl. ..... 156/61; 75/166 C; 148/6.24; 164/84; 164/114; 164/296; 156/74; 156/245; 264/220; 264/311; 428/18
[58] Field of Search ..... 156/61, 245, 74; 148/6.24; 164/114, 84, 286, 290, 296, 15; 249/55; 264/311, 220, 310; 428/17, 18, 19; 75/166 C

[56] References Cited

U.S. PATENT DOCUMENTS

| | | | |
|---|---|---|---|
| 1,511,588 | 10/1924 | Bleecker | 428/18 |
| 2,093,753 | 9/1937 | Ehler | 428/18 |
| 2,370,439 | 2/1945 | Beard | 75/166 C |
| 2,511,552 | 6/1950 | Stuempges | 428/17 |
| 2,565,700 | 8/1951 | Sehiller | 428/19 |
| 2,716,828 | 9/1955 | Adler | 428/17 |
| 2,779,058 | 1/1957 | Hyde | 249/55 |
| 2,826,846 | 3/1958 | Warren | 428/7 |
| 2,896,352 | 7/1959 | Strauss | 264/311 |
| 3,081,211 | 3/1963 | Rickel | 252/79.5 |
| 3,157,558 | 11/1964 | Adler | 428/18 |
| 3,438,839 | 4/1969 | Williams et al. | 428/18 |
| 3,525,659 | 8/1970 | Ebihara | 428/18 |
| 3,672,429 | 6/1972 | Lajoye | 164/114 |
| 3,676,275 | 7/1972 | Sloane | 428/19 |
| 3,801,413 | 4/1974 | Block et al. | 164/45 |
| 3,891,485 | 6/1975 | Lin | 428/18 |

*Primary Examiner*—Edward G. Whitby
*Attorney, Agent, or Firm*—Lowe, Kokjer, Kircher, Wharton & Bowman

[57] ABSTRACT

A method of constructing a model tree structure and the article resulting therefrom constitute the present invention. First a full three-dimensional pattern is constructed from wire and tin-lead. The pattern is then partially flattened and placed in a rubber mold. The mold is filled in around the pattern with rubber and the entire mold with the pattern in place is heated to vulcanize the rubber and form a mold cavity conforming to the configuration of the pattern. A casting metal is provided which preferably is at least 98% lead. Up to 2% antimony may be added to increase flow characteristics. It is also permissible to include a quantity of tin. The part is cast in the mold using centrifugal casting techniques. After the part has solidified and been removed from the mold it is bent into full three-dimensional form corresponding generally to the initial shape of the pattern. An artificial vegetation covering is provided utilizing a non-ferrous, light-penetrable fibrous material to which is adhered a granular, non-ferrous leaf-simulating material. The substrate is first spray painted and then a layer of adhesive is applied. The granular leaf-simulating material is prepared by grinding rubber-like foam with a suitable liquid colorant until a relatively fine granular product results. The granular material is dried and then sprinkled over the adhesive on the substrate. The partially covered substrate is sprayed with lacquer to eliminate any tackiness attributable to the adhesive and to protect the final product. The completed artificial vegetation product is then stretched over the previously cast tree structure.

16 Claims, 9 Drawing Figures

METHOD OF MAKING MODEL TREES AND ARTICLE

This invention relates to the production of miniatures and, more particularly, to a method of producing a novel model tree structure and artificial vegetation and the resulting products.

Model trees have long been used by both hobbyists and professionals. Architectural model makers utilize model trees both to simulate existing green areas and to enhance their artistic license. Model trees used in constructing architectural models have heretofore been constructed by casting a trunk and limb structure and then stretching steel wool over the limbs and finally ahdering a granular material to simulate the tree foliage. While a realistic tree results, there are several disadvantages. One is the relatively great expense in constructing such a tree. The trunk and limb structure is cast from molten metal generally containing in excess of 85% by weight tin which is a relatively expensive metal. Thus, while the trees have been accepted for professional arthitectural models they have never been used to any extent in the more competitive model railroad industry.

Another reason for the lack of acceptance of the trees used by architectural model makers in the model railroad industry is the fact that the steel wool used to hold the simulated foliage on the tree tends to drop particles of the ferrous metal which is attracted by the magnetic field and static electricity set up by the electrified track. The steel wool ultimately reaches the track and is picked up by the engine possibly causing damage to it.

It has heretofore been thought that less expensive metals, such as lead, could not be used in any significant quantity to cast model trees because of the poor flow characteristics of the metal. Another reason for the relatively high cost of trees used heretofore by professionals for architectural models has been the need to employ relatively artistic people to combine the trunk and limb structure with the simulated foliage to present a relatively realistic looking model tree.

It is therefore a primary object of the present invention to provide a more economical model tree utilizing a method which employs casting of the tree and limb structure from molten metal comprising at least 60% by weight lead and preferably at least 85% by weight lead. The present cost of lead being approximately 1/20 the cost of tin, substantial savings result.

Another object of the present invention is to provide a model tree structure and method for constructing the same which is economically competitive with plastic trees yet is as realistic in appearance as present cast metal trees.

It is also an objective of this invention to provide a model tree structure and method of constructing same which is more realistic in appearance than present plastic trees and is characterized by complete absence of ferrous metal and any other substance which would conduct static electricity therefore making it highly utilizable in conjunction with model railroads.

It is also an aim of this invention to provide a model tree structure which is more realistic than model trees heretofore constructed as a result of a larger cross-sectional area being possible for the trunk and limb structure because of substantial savings in the cost of the casting metal.

Still a further objective of this invention is to provide a model tree structure and method of constructing same which is more truly three-dimensional than trees of the prior art as a result of the fact that the pattern from which the tree is constructed is first made in a full three-dimensional form and then is partially flattened prior to placing the pattern in a mold to form the mold cavity.

Another very important object of this invention is to provide a model tree structure as set forth in the foregoing objects which does not require a highly skilled and highly artistic person to assemble the tree and limb structure with the simulated foliage in order to effect a realistic looking model tree.

As a corollary to the above object, an aim of the invention is to provide a method of constructing model trees wherein the simulated vegetation for the tree and limb structure is completed off of the tree and then pulled over the tree limbs as a final step.

It is another one of the aims of the present invention to provide novel simulated vegetation covering and method of making same which provides for substantially complete forming of the simulated vegetation on a production line basis thus resulting in labor saving and requiring less artistic talent.

Still another objective of the invention is to provide simulated vegetation covering as described in the foregoing aim and method of constructing same which can be utilized with any type of tree and limb structure and on all types of surfaces.

Still another important objective of the invention is to provide for simulated vegetation covering and method of constructing same which is characterized by an absence of any ferrous metal and any other substance which could conduct static electricity therefore making the vegetation highly utilizable with model railroads.

The foregoing and other objects will become apparent from a complete reading of the following description and claims when taken in light of the accompanying drawings, wherein:

The first step in constructing a model tree structure according to the method of the present invention is to construct a pattern by hand using material capable of withstanding the temperatures and pressures of the mold, e.g., twisted wire and tin-lead. The techniques for doing this are well known to those skilled in the art although the teaching has heretofore been to construct the pattern in only partial three-dimensional form so that it will fit within a rubber mold which is normally under two inches in thickness. The present method may utilize the pattern-making techniques of the prior art or may depart therefrom by constructing the pattern in full three-dimensional form. The latter normally entails constructing a pattern with limb structures extending from the basic trunk of the tree in at least two planes and even more in some instances. In order to fit the pattern within the mold, after it is fully completed, it is partially flattened to reduce its thickness.

Figure 1:
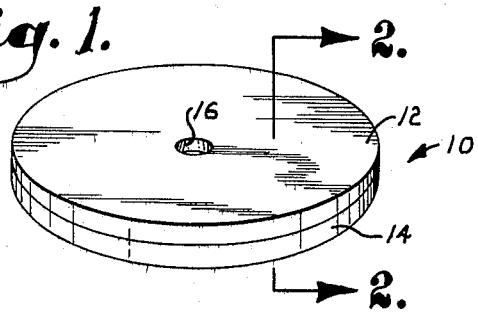
FIG. 1 is a perspective view of a mold for constructing a model tree structure according to the present invention.
Figure 2:
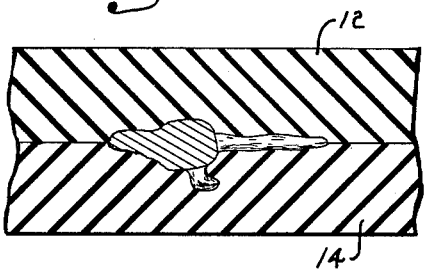
FIG. 2 is an enlarged vertical cross-sectional view taken along line 2—2 of FIG. 1.
Figure 3:
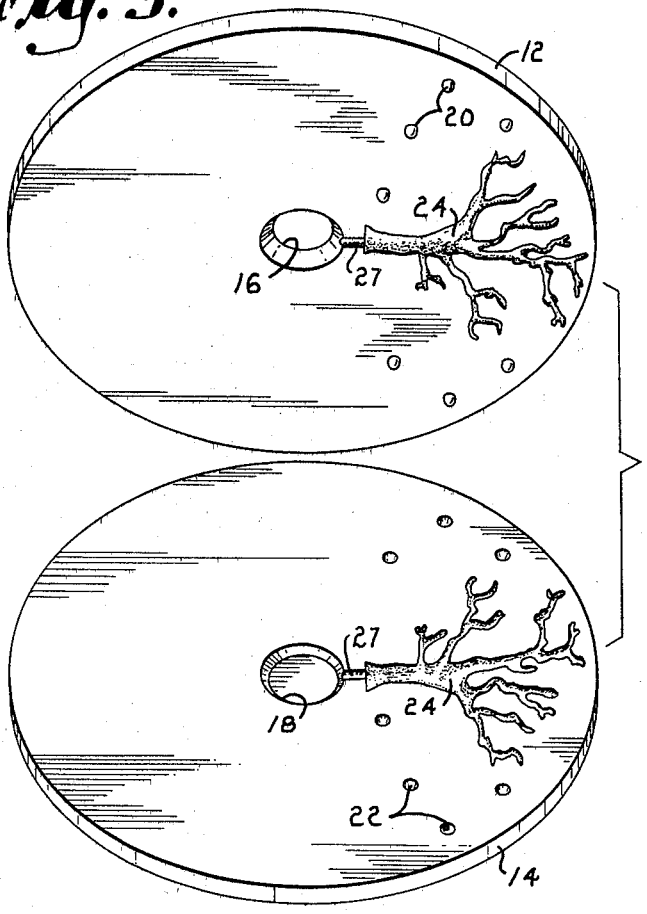
FIG. 3 is an enlarged perspective view of the mold in which the tree structure is formed with the two mold halves being opened to illustrate the mold cavity.

The pattern is then placed in a live rubber mold which is designated generally by the numeral 10 in FIG. 1. Mold 10 comprises two mold halves 12 and 14 each of which is characterized by a centrally disposed opening 16 and 18 respectively. Each mold half 12 and 14 is one inch or less in thickness. The mold half 12 is characterized by a plurality of detent-like projections 20 which are positioned in complemental relationship to a like number of dimples 22 in mold half 14. Projections 20 and dimples 22 when in complemental engagement hold the two mold halves in proper alignment.

It is to be understood that prior to placing the pattern in the mold there is no mold cavity in either of the two disc halves, the same presenting substantially flat planar surfaces. The pattern is placed on one surface of one of the discs 12 or 14 and the disc is rough cut to fit the pattern. Additional rubber is added in some instances, where necessary, to fill in the raised-most sections of the pattern and the two discs are then clamped together and heated to vulcanize the rubber and form a mold cavity 24 in each of the two mold halves corresponding to the partially flattened tree pattern. The final step in preparation of the mold is to cut a channel 27 in each disc between the mold cavity and the opening 16 or 18. This channel allows molten metal introduced through openings 16 and 18 to pass into the mold cavity.

Next, the part is molded by placing mold 10 on the circular bed of a centrifugal casting machine. Pressure is utilized to seal the two mold halves 12 and 14 and molten metal is introduced into the mold to fill cavity 24. It is to be understood, of course, that there will normally be a plurality of cavities 24 around the circumference of the mold although for the sake of simplicity and brevity only a single cavity has been shown in the mold illustrated in the drawings.

The molten metal utilized to cast the tree structure is an important part of the present invention. It has heretofore been thought that metal containing an extremely high lead content could not be cast for the purpose of constructing model trees because of the relatively poor flow characteristics of such a metal when compared with the more expensive tin. The casting metal used in the present invention, however, comprises at least 60% by weight lead and preferably from 85% to 100% by weight lead. Optimum results are obtained with a lead content greater than 95% (by weight). While up to 40% by weight tin or other compatible metal can be utilized in the casting metal of the present invention, this will normally increase costs significantly without attendant structural advantages. Preferably, if any tin is added, it should not exceed 2% which will increase rigidity and structural strength somewhat without unduly increasing cost. It is preferable to utilize from ½% to 2% by weight antimony in the casting metal to increase flow characteristics. The molten metal should be at a temperature of between 550° and 900° F. immediately prior to casting.

Metal is introduced into the mold while the latter is spinning at a speed of from 350 to 800 rpm. A pressure of up to 40 p.s.i. may be applied to the two mold halves 12 and 14 to seal the mold cavity during casting of the part.

Figure 4:
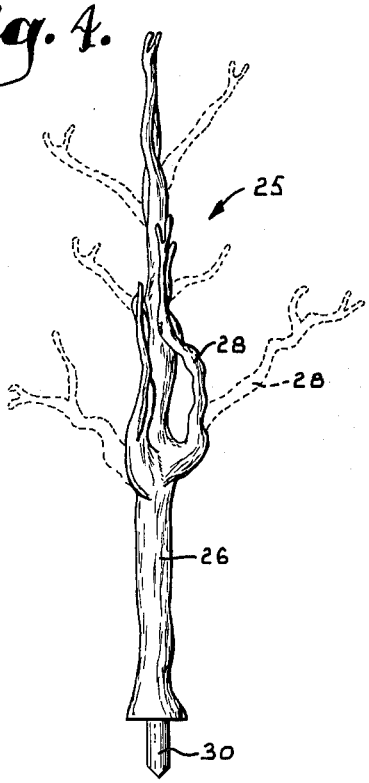
FIG. 4 is a side elevational view of a formed tree structure as it appears immediately after extraction from the mold with the full three-dimensional form of the tree structure being illustrated in broken lines.
Figure 5:
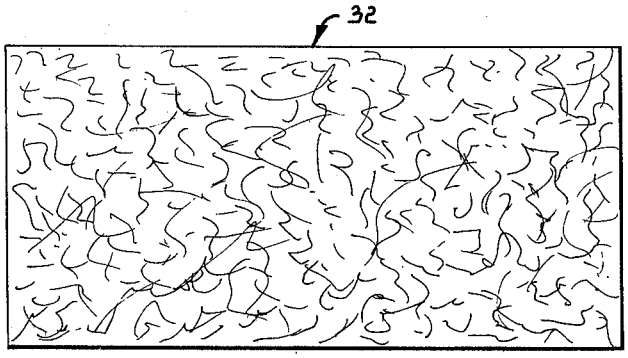
FIG. 5 is a plan view of the substrate which is used to hold the leaf-simulating material.

The cooled and hardened metal presents a tree structure such as that shown in FIG. 4 and designated generally by the numeral 25. Tree structure 25 comprises a trunk 26 and a plurality of limbs 28. A projection 30 at the base of trunk 26 presents a stake for inserting the tree structure in an appropriate supporting surface.

As the structure 25 is in a partially flattened position when it is removed from the mold, it may be left in this condition if it is to be shipped as a part of a kit to be assembled by a user. On the other hand, if a model tree complete with foliage is to be immediately constructed, limbs 28 are moved to the broken line positions illustrated in FIG. 4 so as to approximately correspond with the original full dimensional form of the pattern.

The tree structure 25 may also be colored by painting and/or subjecting the structure to a caustic solution. In this regard, sodium sulphide and ammonium sulphide have been found to be highly effective to provide an uneven oxidizing action which closely simulates a bark pattern on a living tree. Other caustic liquids such as sulphuric acid and copper sulfate may also be utilized to achieve the desired effect. If the tree structure is to be painted this will be done after subjecting it to the caustic solution.

One reason for being able to utilize a casting metal having a relatively high lead content in the process of the present invention is that the pattern for the model tree structure is formed with a relatively large cross-sectional dimension for the trunk and the limbs of the tree. Thus, the mold cavity has a relatively large cross-sectional dimension so as to provide less resistance to flow for a given quantity of material. In some uses the material may even be cast without the use of centrifugal forces. Such a relatively large cross-sectional area for the mold cavity has not heretofore been possible because of the use of the relatively expensive tin. That is, the economics of model tree building has heretofore dictated that the cross-sectional area of the trunk and limbs be minimized so as to minimize the amount of material utilized. Utilizing the method of the present invention, however, it is possible to form a tree structure having a larger cross-sectional area because of the relatively inexpensive material used. Use of the relatively large cross-section of area not only favors use of the less expensive material but also results in a sturdier more realistic looking tree structure.

The present invention also contemplates a novel simulated vegetation product prepared according to the following novel method. First of all, a substrate 32 of non-ferrous, light-penetrable fibrous material such as polyester fiber is cut into a relatively large sheet (for example, enough to form foliage for several trees). The fibrous material should not only be non-ferrous so as not to be subject to magnetism but preferably is also characterized by an inability to conduct static electricity. A suitable substrate has been formed from Dacron material characterized by at least 50% to 75% light penetrability and a density of no greater than 0.25 ounces per square foot. This type of material is presently used in higher densities for air filters and upholstery padding.

Figure 8:
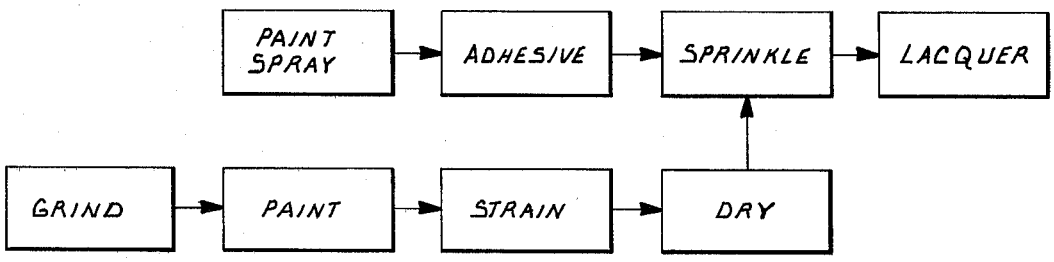
FIG. 8 is a diagrammatical illustration of the steps involved in constructing the artificial vegetation according to the method of the present invention.

Thhe substrate is prepared according to the sequence illustrated in the block diagram of FIG. 8. First of all, the substrate is sprayed with paint on both sides to provide it with a green vegetation color. Next, a spray adhesive is applied to both sides of the colored substrate and before the adhesive dries the substrate is partially covered by sprinkling it with a leaf-simulating material.

Figure 6:
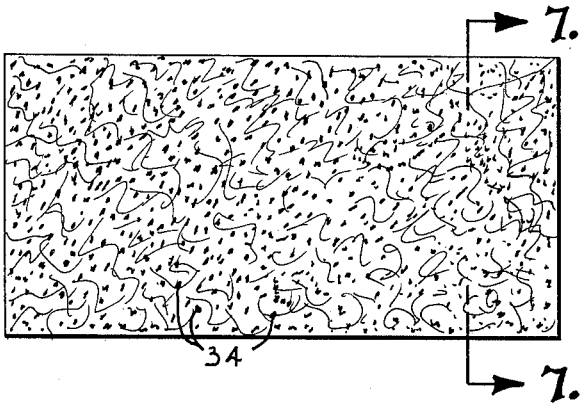
FIG. 6 is a top plan view similar to FIG. 5 after the substrate has been partially covered on both sides with the leaf-simulating material.
Figure 7:
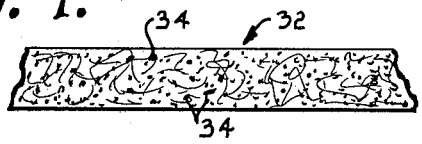
FIG. 7 is a cross-sectional view taken along line 7—7 of FIG. 6 illustrating the completed cross-sectional construction of the substrate covered with the leaf-simulating material.

The leaf-simulating material is prepared according to the steps shown in the lower half of the diagram in FIG. 8. It is preferable to utilize a rubber-like foam material, for example, shredded latex or urethane foam for the leaf-simulating material. Preferably, the leaf-simulating material should be a non-conductor of static electricity. The foam or other rubber-like material is ground in a blender with a suitable colorant, for example, pigment and water. By grinding the foam with the liquid colorant the particle size is reduced while the material is also effectively colored. It has also been found that the particle size is much more even when such a rubber-like material is ground wet rather than ground or grated dry. This eliminates any need for sizing of the ground product. A quantity of 20 ounces of shredded foam rubber and 12 ounces of liquid colorant (pigment in water) provides a quantity which can be easily processed in a household blender. The material is ground for 1–2 minutes on the highest blender speed after which the excess colorant is strained from the ground material and the latter is allowed to dry at a temperature of approximately 100°–150° for about one hour. Manifestly, room temperature drying may be achieved over a longer period. The dried material is then sprinkled over the substrate having the tacky adhesive as above described. It is contemplated that other granular materials, e.g., sawdust may also be utilized in the foliage making process. As a final step, it may be desirable to spray the partially covered substrate with lacquer to remove the tackiness caused by the adhesive and present a more workable product. This may be clear lacquer or a tinted lacquer so as to provide for final color control. The substrate 32 is illustrated in FIGS. 6 and 7 with the granular material 34 dispersed throughout.

Finally, the partially covered substrate is trimmed to an appropriate size for the desired purpose such as a ground cover or as foliage simulant for a particular tree structure 25. The substrate 32 may be pulled over the limbs of the tree to simulate the tree foliage. A very realistic foliage covering is obtained according to the foregoing steps.

Figure 9:
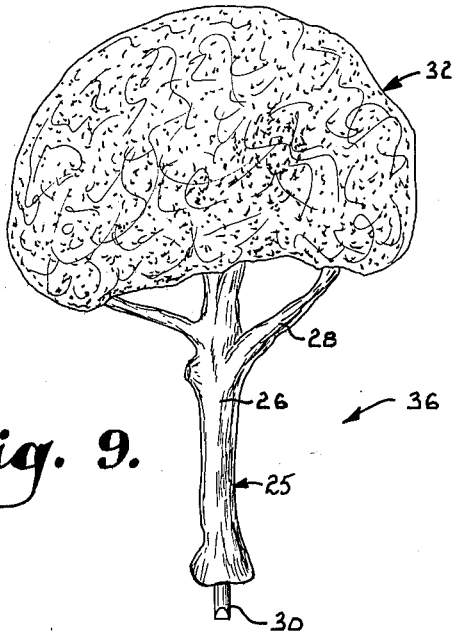
FIG. 9 is a perspective view of a completed model tree formed according to the method of the present invention.

An important aspect of the invention is that the simulated foliage product constructed according to the foregoing method may be utilized with existing trunk and limb structures as well as the structure 25 constructed according to the process of the present invention. Substantial labor saving results from the fact that the foliage process of the present invention allows the completed foliage to be formed off of the tree utilizing production line techniques. When the product is applied to the tree and limb structure, it is simply cut to size and then pulled over the structure. Very little artistic talent is required to make a complete tree with foliage which is actually more realistic in appearance than trees constructed according to prior art teachings. A completed model tree is illustrated in FIG. 9 and designated by the numeral 36.

The artificial vegetation prepared according to the invention is easily layered and separated by hand to create different degrees of compactness and coarseness. Thus, an unlimited variety of vegetation can be created. This includes everything from ground covers such as grass and forage crops to tree foliage, vines and bushes. The applications for the product are limited only by the imagination of the person utilizing it.

Having thus described the invention, I claim:

1. A method of constructing a model tree comprising a relatively thick trunk and a plurality of relatively thin limb portions from a three dimensional pattern and a mold utilizing centrifugal casting techniques, said method comprising:

forming said mold to present a mold cavity presenting said trunk and limb portions conforming to the shape of said pattern;

providing a molten metal composition comprising at least 60% by weight lead;

introducing into said mold cavity a quantity of said molten metal;

centrifugally casting said molten metal to distribute the latter throughout the mold cavity; and solidifying said molten metal to present a tree structure.

2. A method as set forth in claim 1, wherein the step of providing a casting metal comprises providing a metal including tin and antimony.

3. A method as set forth in claim 2, wherein the step of providing a casting metal comprises providing a metal of tin content up to 40% by weight.

4. A method as set forth in claim 1, wherein the step of providing a casting metal comprises providing a metal of antimony content from ½% to 2% by weight.

5. A method as set forth in claim 1, wherein the step of providing a casting metal comprises providing a metal of at least 95% by weight lead.

6. A method as set forth in claim 1, wherein the step of providing a casting metal comprises providing a metal wherein the balance is antimony.

7. A method as set forth in claim 1, wherein is included the step of forming said three dimensional pattern ahead of said mold forming step.

8. A method as set forth in claim 7, wherein said pattern forming step comprises building said pattern initially in full three dimensional form and then partially flattening said pattern.

9. A method as set forth in claim 8, wherein is included the additional steps, subsequent to said solidifying step of removing the solidified tree structure from the mold and bending the tree structure into full three dimensional perspective corresponding generally to the full three dimensional form of said pattern.

10. A method as set forth in claim 1, wherein is included the additional step of removing the solidified tree structure from the mold and subjecting said structure to a caustic solution to form additional surface patterns in at least a portion of the structure.

11. A method as set forth in claim 1, wherein is included the steps of removing the solidified tree structure from the mold and providing an artificial foliage covering over said tree structure.

12. A method as set forth in claim 11, wherein the step of providing an artificial foliage covering comprises providing a mat-like substrate of non-ferrous, light-penetrable, fibrous material; applying an adhesive to said substrate; at least partially covering said substrate with a non-ferrous, leaf-simulating material; and pulling said partially covered substrate over said tree structure.

13. A method as set forth in claim 12, wherein the step of at least partially covering said substrate comprises sprinkling a granular material on the substrate.

14. A method as set forth in claim 13, wherein is included the step of preparing said granular material from rubber-like foam prior to sprinkling on the substrate, said preparation step comprising grinding the rubber-like foam and a liquid colorant therefor to form a granular material, and drying said granular material to remove excess liquid.

15. A method as set forth in claim 13, wherein is included prior to said pulling step, the step of spraying a lacquer finish over said partially covered substrate.

16. A method as set forth in claim 15, wherein is included the step of coloring said substrate prior to applying said adhesive.

* * * * *